United States Patent [19]

Brothers

[11] Patent Number: 4,757,741

[45] Date of Patent: Jul. 19, 1988

[54] MEANS FOR EFFECTING RANDOM DISPERSION OF BULLETS

[76] Inventor: Jack Brothers, 806 Tuxedo Dr., Fort Walton Beach, Fla. 32548

[21] Appl. No.: 937,912

[22] Filed: Dec. 3, 1986

[51] Int. Cl.[4] ..... F41F 17/12

[52] U.S. Cl. ..... 89/14.05; 42/79; 89/41.13

[58] Field of Search ..... 42/79; 89/14.05, 14.2, 89/14.3, 41.13

[56] References Cited

U.S. PATENT DOCUMENTS

| | | | |
|---|---|---|---|
| 966,889 | 8/1910 | Devol | 42/79 |
| 3,329,063 | 7/1967 | Ehrenburg et al. | 42/79 |
| 4,351,223 | 9/1982 | Schmidt | 89/14.05 |

FOREIGN PATENT DOCUMENTS

| | | | |
|---|---|---|---|
| 997788 | 1/1952 | France | 42/79 |

*Primary Examiner*—Stephen C. Bentley
*Attorney, Agent, or Firm*—Bernard J. Murphy

[57] ABSTRACT

The invention is of a sleeve or cylinder, receivable on the muzzle end of a rifle or the like, which has at least one vibratory reed or finger projecting therefrom. As rounds exit the muzzle, gasses from the firing intrude between the bullets and the reed(s) or finger(s) causing vibration, uneven gas compression within the muzzle end of the weapon and against a given side of emerging bullets. As a consequence, the aimed accuracy of the bullets is slightly disturbed so that the bullets impact in a wider target zone than the otherwise precisioned accuracy of the weapon would indicate.

5 Claims, 3 Drawing Sheets

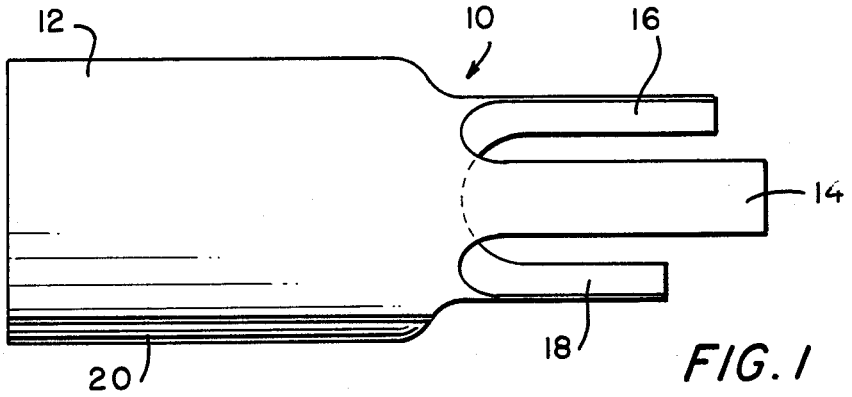
FIG. 1
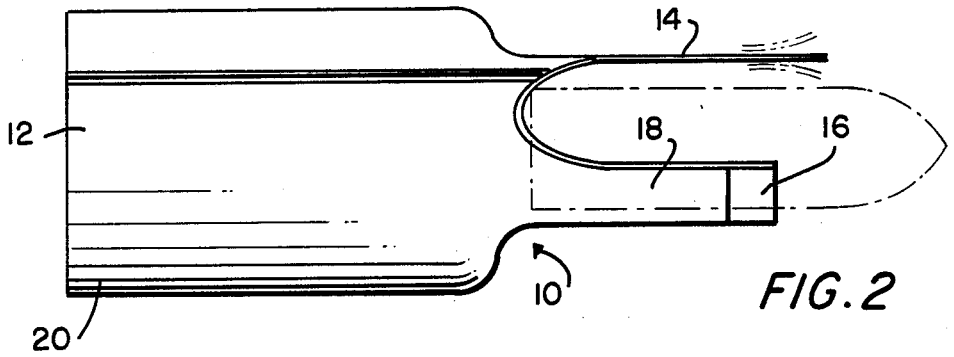
FIG. 2
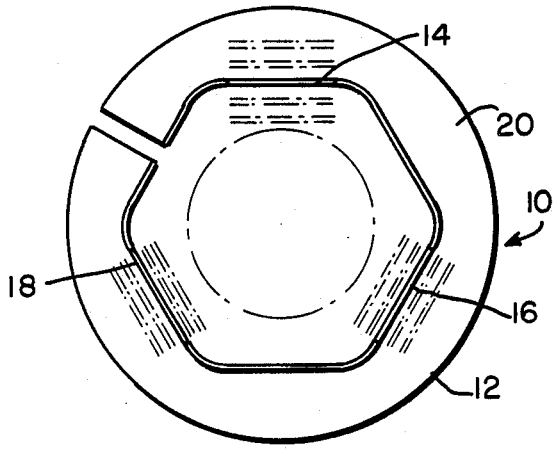
FIG. 3
FIG. 4
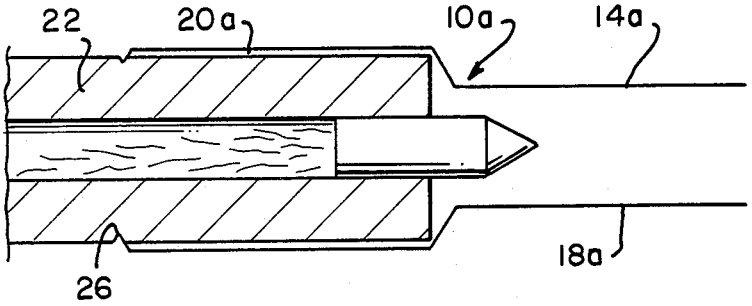
FIG. 4A
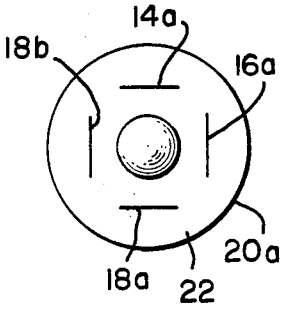

10a
14a
16a
18a
18b
20a
22
24

MEANS FOR EFFECTING RANDOM DISPERSION OF BULLETS

This invention pertains to weapons and the ballistics thereof, and in particular to means for effecting random dispersion of bullets from a gun barrel, as well as to a blank for forming therefrom means for effecting random dispersion of bullets from a gun barrel.

All known prior art, having to do with weapons and the ballistics thereof, is drawn to the purpose of improving the accuracy of weaponry. Heretofore, no one has proposed to set forth means for diminishing the accuracy of weaponry. Even so, that is quite the essential object of this invention.

Particularly, it is an object of this invention to set forth means for effecting random dispersion of bullets from a gun barrel, comprising a sleeve, for coupling thereof to the muzzle of a gun barrel; wherein said sleeve has at least one vibratory reed or finger at an end thereof.

It is also an object of this invention to disclose a blank, for forming therefrom means for effecting random dispersion of bullets from a gun barrel, comprising a flat sheet of material having at least two straight sides; wherein said sheet has at least one vibratory reed or finger extending from an edge thereof which joins said two sides.

Further objects of this invention, as well as the novel features thereof, will become more apparent by reference to the following description taken in conjunction with the accompanying figures, in which:

FIG. 1 is a plan or top view of the novel means, according to an embodiment thereof;

FIG. 2 is a side view of the embodiment of FIG. 1;

FIG. 3 is an end view of the embodiment of FIGS. 1 and 2, taken from the right-hand side of FIG. 2;

FIGS. 4 and 4A through 11 and 11A are graphic depictions of the effect of the means for effecting random dispersion of bullets, according to a second embodiment thereof, the means shown coupled to the muzzle of a gun barrel;

Figures 5, 5A, 6, 6A, 7, 7A, 8, 8A, 9, 9A, 10, 10A, 11, 11A:
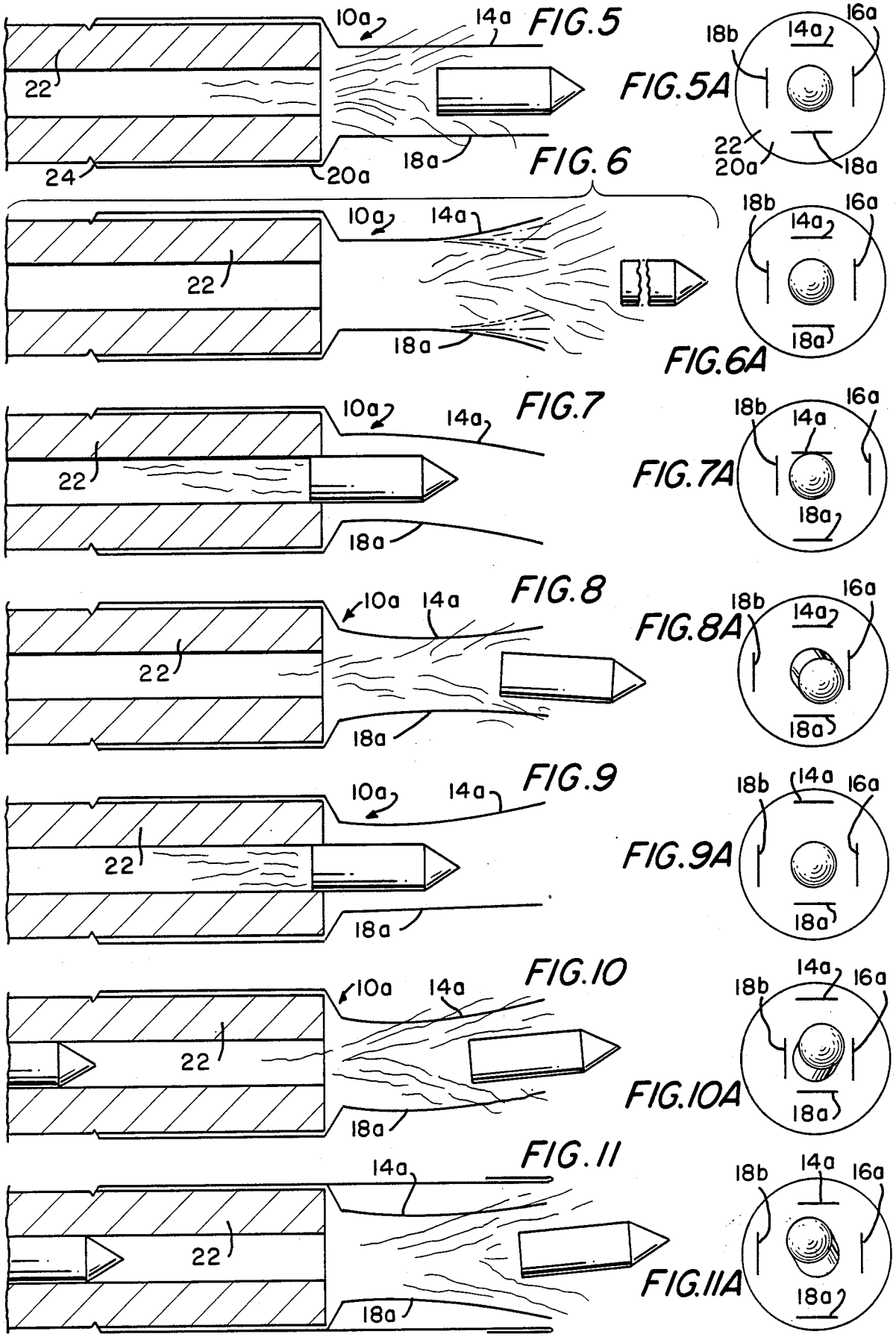

When a soldier is suddenly surprised by an enemy infantryman, for instance, he will turn his rifle toward the latter and generally aim to shoot the enemy. However, this can all occur within seconds, and the soldier has to little time to aim accurately. He will get off a burst of bullets where he aims his weapon, but he could be off by six inches, eight inches, etc., and completely miss his target—the enemy. His weapon being carefully and precisely machined to effect accurate fire, will impact bullets only where they are aimed. If that's to the left or the right of the enemy, or slightly above the head of the enemy, the rounds will be without effect and perhaps the return fire from the enemy may prove to have more deadly result. If a soldier is to do some distant sharp-shooting at an entrenched enemy, then it is well for his weapon and his firing thereof to have a most precisioned accuracy. But, when he is scouting an enemy-occupied building, for instance, in which he may be confronted at any moment from above, the rear, from behind a wall, etc., it would be most desirable that, when he fires upon an unexpectedly-appearing enemy, his firing pattern blanket a widely dispersed area. In this way, if he aims off target six or eight inches, some of the dispersed rounds will find the target, even if most do not.

In FIGS. 1–3, then, is depicted means 10 for effecting random dispersion of bullets from a gun barrel, the same comprising a sleeve 12 of cylindrical conformation with three vibratory reeds or fingers 14, 16 and 18 projecting form an end of the sleeve 12. By way of example, the embodiment here depicted is formed of spring steel. The body 20 portion of the means 10 is of cylindrical conformation, as noted, but the reeds or fingers 14, 16 and 18 are flat. As can be seen in FIGS. 1 and 2, the fingers or reeds 14, 16 and 18 are of diverse lengths. Consequently, each thereof will respond differently to pressure. As rounds exit from the body 20 and pass through the fingers or reeds 14, 16 and 18, the gasses exiting with the rounds will insinuate themselves between the rounds and the fingers or reeds. The proximity of the rounds to the fngers or reeds causes the intervening gasses to be pressured and, resultantly, the fingers or reeds are set into vibration. In turn, the vibration of the fingers or reeds further pressure the gasses, cyclically (as each round exits), and different ones of the rounds, therefore, are randomly slightly displaced in their exiting paths. Clearly, if single rounds of bullets are squeezed off, the gasses will not build up in the gun barrel and, consequently, each singled round will target with all the accuracy built into the weapon. It is in the firing off of bursts of rounds where the gasses accumulate and vie with the rounds in exiting the muzzle, and cause the gas pressure excursions to manifest themselves at sides of the different rounds where the fingers or reeds 14, 16 and 18 are located.

FIGS. 4 and 4A through 11 and 11A more graphically depict the functioning of the invention in connection with an alternate embodiment **10*a* of the novel means. In this embodiment, the reeds 14*a*, 16*a*,18*a*,18*b*, are of common length. Due to imprecision in manufacture, however, and due to vagaries in metallic structure in each reed, the four will not vibrate in common under the same circumstances; each will have its own distinct harmonic. By chance, then, as illustrated in FIGS. 4 and 4A through 6 and 6A, some one or more rounds in a burst—or a singled off round—will cause no dispersion thereof. That is, if a first round is discharged, it will exit without being influenced by the reeds 14*a*, 16*a*,18*a*,18*b*. As shown in FIGS. 7 and 7A through 11 and 11A**, random differing vibrations of the reeds will effect diverse random dispersions of rounds in a burst thereof. The deflected flights of the rounds are shown.

Only by way of example, means **10*a* is shown with an end thereof clinched about a gun barrel 22 which has an annular groove 24 formed therein in which to latch the end of the body 20*a*. Understandably, the body 20*a* could be internally threaded, and the outer surface of the barrel 22 threaded to receive it. Too, the body 20*a* could carry a sort of pipe clamp thereabout to facilitate its mounting to a muzzle quickly, without undue complication. these and other manners of securing the body 20*a* (and/or body 20,FIGS. 1–3**) are deemed to be academic, and well within the ken of those of ordinary skill in this art.

Figure 13:
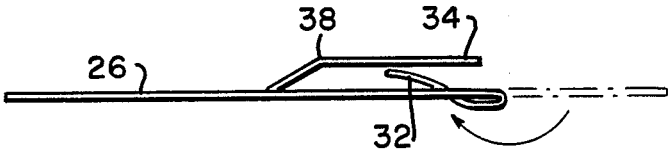
FIGS. 12 through 14 illustrate the novel blank for forming the means for effecting random dispersion of bullets in yet a further embodiment thereof in which the means incorporates damping limbs.
Figure 14:
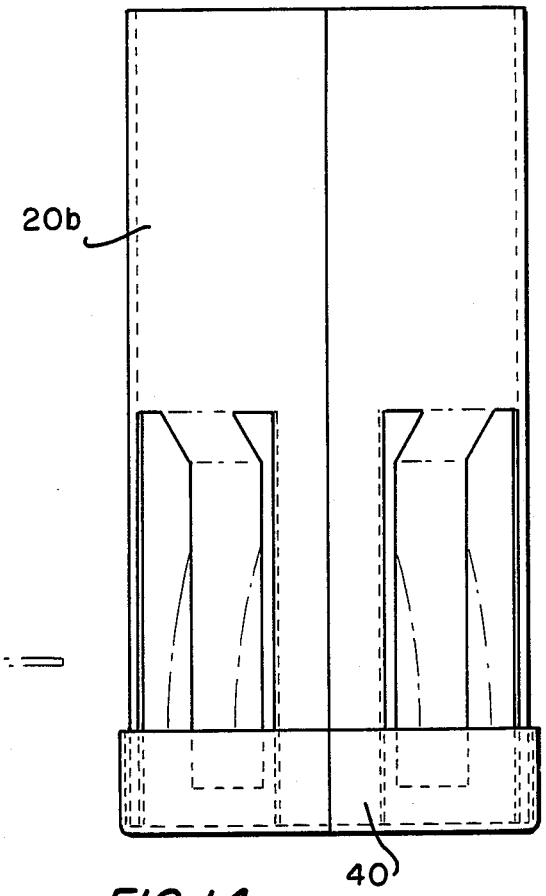
Figure 12:
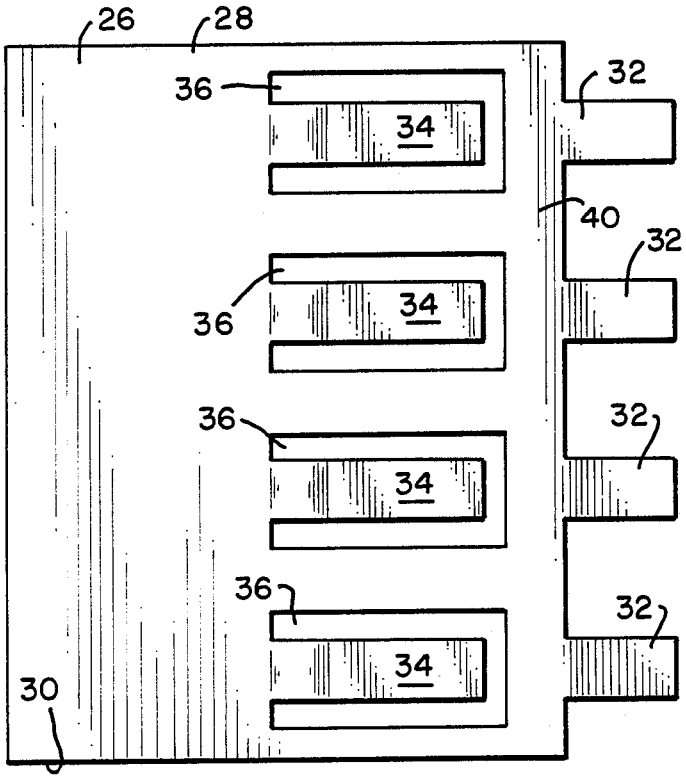
Figure 15:
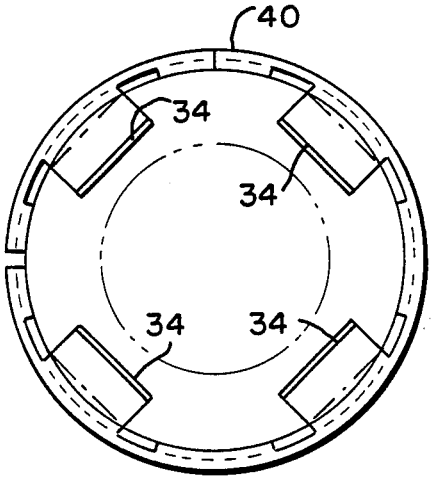
FIG. 15 is an end view of the circularly formed blank of FIG. 14, the same being taken from the bottom of FIG. 14, but omitting the damper means to show the vibratory reeds with more clarity.

The invention contemplates the means for forming the novel bullet dispersers. In FIGS. 12 through 14 depict a novel blank 26 from which means for causing random dispersion of bullets is made. The blank 26 has straight sides 28 and 30 which are joined to form a cylindrical body 20*b*. Sides 28 and 30, in the formed bullet disperser, are held in abutting relationship by the resilience of the material of the blank; optionally, however, they could be spot welded, or equal. Four limbs 32 extend from one end of the blank 26 and they are collinearly aligned with four reeds 34 formed in the blank by four U-shaped cut-outs 36. The reeds 34 are bent, as shown in FIG. 13, to define thereof a knee 38 from which the rest of each reed 34 extends, in cantilever fashion, in parallel with the plane of the blank 26. Too, the limbs 32 are bent back upon themselves, by the "cuffing" back of the ligament 40—which is interposed between the limbs 32 and the reeds 34. The turned back or cuffed ligament strengthens the formed disperser.

If the reeds 34 are allowed to manifest unrestricted vibration, it is possible that they will fatigue and break away. Also, if the vibration thereof is too excessive, ends of the reeds 34 could contact the rounds with perhaps disastrous results. Therefore, my invention comprises means for damping the vibratory excursions of the reeds 34, and the damping means are provided by the bent back, or turned back limbs 32. As can be seen with particular clarity in FIG. 13, the ends of the limbs 32 are bent back to near proximity to the reeds 34. The degree of proximity accommodates that degree of vibration for the reeds. But if the reeds attempt to exceed the optimum amplitude, the limbs 32 inhibit this.

It is to be appreciated that may invention requires no modificaton of the weapon. With the greatest of facility, the bullet disperser means 10 and/or 10*a* can be slipped onto the muzzle of a rifle or the like under any combat conditions, in darkness, rain, cold, etc. This can be done with an interference fit, or with a pipe clamp (as suggested), etc. just as easily, too, it can be removed from the muzzle when it is desired to employ the built-in accuracy of the weapon.

While I have described my invention in connection with specific embodiments thereof, it is to be clearly understood that this is done only by way of example and not as a limitation to the scope of my invention as set forth in the objects thereof and in the appended claims.

I claim:

1. Means for effecting random dispersion of bullets from a gun barrel, comprising:

a sleeve, having a given inside diameter, for coupling thereof to the muzzle of a gun barrel which has an outside diameter substantially corresponding to said given inside diameter, and (b) defines a bullet exit pathway of a specified diameter;

said sleeve has a plurality of vibratory reeds or fingers at an end thereof arranged in a generally radial pattern which substantially defines a diameter, occupied by said reeds or fingers, which is greater then said specified diameter of such pathway, and smaller than said inside diameter of said sleeve, to accommodate propellant gasses between said reeds or fingers and bullets exiting from such muzzle, and to insure that such reeds or fingers do not contact such exiting bullets.

2. Means for effecting random dispersion of bullets, according to claim 1, wherein:

said sleeve has a central, elongate axis; and said reeds or fingers of said plurality thereof are spaced apart equidistantly about said axis.

3. Means for effecting random dispersion of bullets, according to claim 1, wherein:

said sleeve has a cylindrical body; and at least the outermost ends of said reeds or fingers are flat.

4. Means for effecting random dispersion of bullets, according to claim 3, wherein:

said reeds or fingers extend inwardly relative to said body.

5. Means for effecting random dispersion of bullets from a gun barrel, comprising:

a sleeve, for coupling thereof to the muzzle of a gun barrel; wherein said sleeve has a plurality of vibratory reeds or fingers at an end thereof; and said reeds or fingers of said plurality thereof are of diverse lengths.

* * * * *